United States Patent [19]

Schuller et al.

[11] 3,933,384

[45] Jan. 20, 1976

[54] ANTI-PILFERAGE LOCKING DEVICE

[75] Inventors: James J. Schuller, Crete, Ill.; Ronald W. Marsh, Michigan City, Ind.

[73] Assignee: Pullman Incorporated, Chicago, Ill.

[22] Filed: Oct. 7, 1974

[21] Appl. No.: 512,774

[52] U.S. Cl. ..... 292/285; 292/DIG. 32

[51] Int. Cl. ..... E05c 19/08

[58] Field of Search ..... 292/DIG. 32, 302, 283, 292/284, 67, 114, 277, 285, 286

[56] References Cited

UNITED STATES PATENTS

| | | | |
|---|---|---|---|
| 968,190 | 8/1910 | Patch | 292/218 X |
| 1,507,593 | 9/1924 | Galloway | 292/286 |
| 3,279,839 | 10/1966 | Madland | 292/284 |
| 3,434,751 | 3/1969 | Tantlinger et al. | 292/218 |
| R21,942 | 11/1941 | Hartwig | 292/285 |

*Primary Examiner*—Richard E. Moore
*Attorney, Agent, or Firm*—Richard J. Myers

[57] ABSTRACT

An anti-pilferage locking device for securing two confronting edges of an outer door structure in a railway car against longitudinal relative movement having a hasp pivotally secured to the outer surface of the car door structure adjacent to one of the confronting edges, a keeper secured to the outer surface of the car adjacent the opposite confronting edge of the car door structure, a cam vertically spaced from the keeper and pivotally secured to the outer surface adjacent said opposite confronting edge and above said keeper, and an anti-pilferage sealing means connecting with the cam and the keeper and trapping the hasp, the lower horizontal edge of the cam being flat at one end and curved at the other to control cam rotation relative to the hasp, the keeper having an outer vertical lip entrapping the hasp which entraps said lower edge of the cam; whereby, the hasp is receivably entrained on the keeper, the cam limits vertical movement of the hasp, and the sealing means is cooperatively received through the cam and keeper to sealingly secure the hasp on the keeper.

3 Claims, 3 Drawing Figures

ANTI-PILFERAGE LOCKING DEVICE

BACKGROUND OF THE INVENTION

1. Field of the Invention

This invention pertains to the railway car art and in particular relates to an anti-pilferage device for securing two confronting edges of the outer door structure of a railway car.

2. Description of the Prior Art

It is well known in the prior art to provide a locking device for securing two confronting edges of an outer door structure of a sliding door and a fixed post or two sliding doors in a railway boxcar. A variety of securing means have been used for this purpose as, for instance, shown by U.S. Pat. No. 3,596,959 to R. Ferris granted Aug. 3, 1971. An additional lock may be used on the boxcar above the securing means for an additional lock at such height above the ground that this additional lock could not be easily reached and therefore functions as an anti-pilfering device. Such additional anti-pilfering device or lock may take the form as shown by U.S. Reissue Pat. No. 21,942 to A. Hartwig, reissued Nov. 11, 1941 and incorporated herein by reference thereto. This anti-pilfering lock provides for a hasp secured to the outer surface of the car door structure adjacent to one confronting edge and engaged on a keeper secured to the outer surface adjacent to the opposite confronting edge of the door structure. A freely pivotal arcuate cam member is also provided to wedgingly engage the hasp on the keeper. While this structure clearly provides a means of securing the door structure in a closed position, it does not disclose any means of securing the cam above the keeper where the cam limits upward vertical movement of the hasp on the keeper which limits horizontal and downward movement of the hasp. Consequently, since the cam is freely pivotal, it can be dislodged from its position to permit the hasp to get free of the keeper through structural vibrations resulting from normal rail use of the railway car. The proposed inventive design disclosed below overcomes this undesirable possibility of uncoupling of the hasp from the keeper.

SUMMARY

The invention relates to an anti-pilferage locking device for securing two confronting edges of an outer door structure in a railway car against longitudinal relative movement.

The invention is adapted for use with a door structure including either sliding double doors having confronting edges; or alternately, a single sliding door confronting the frame or door post of the car door structure. The invention provides a means of preventing pilferage while the railway car is in transit or awaiting transit, and additionally provides a secondary door locking device capable of sustaining the impact loads impressed on the door structure.

It is a general object of this invention to provide an anti-pilferage locking device having an elongated hasp pivotally secured on the outer surface of the car adjacent to one of the confronting edges and receivably entrained on a keeper secured to the outer surface of the car adjacent to the opposite confronting edge and having a cam entrapping the hasp against upward vertical movement from the keeper.

Another object of the invention is to provide a hasp retaining means in the keeper to restrain outward lateral movement of the hasp entrained on the keeper.

It is a further object of the invention to provide an anti-pilferage sealing means cooperatively received through an aperture in the cam structure and an aperture in the keeper to sealingly secure the hasp in a position entrapping it on the keeper.

Another object is to provide a cam having a bottom edge that is flat at the end opposite the door structure confronting edges and is curved or arcuate at the other end of the cam bottom edge adjacent the confronting edges. Also the curved end of the bottom edge is horizontally offset from the pivot point of the cam and spaced above the hasp to eliminate any tendency of the hasp to move the cam away to allow the hasp to escape.

These and other objects will become apparent from reference to the following description and attached drawings and appended claims.

DESCRIPTION OF THE PREFERRED EMBODIMENT

Figure 1:
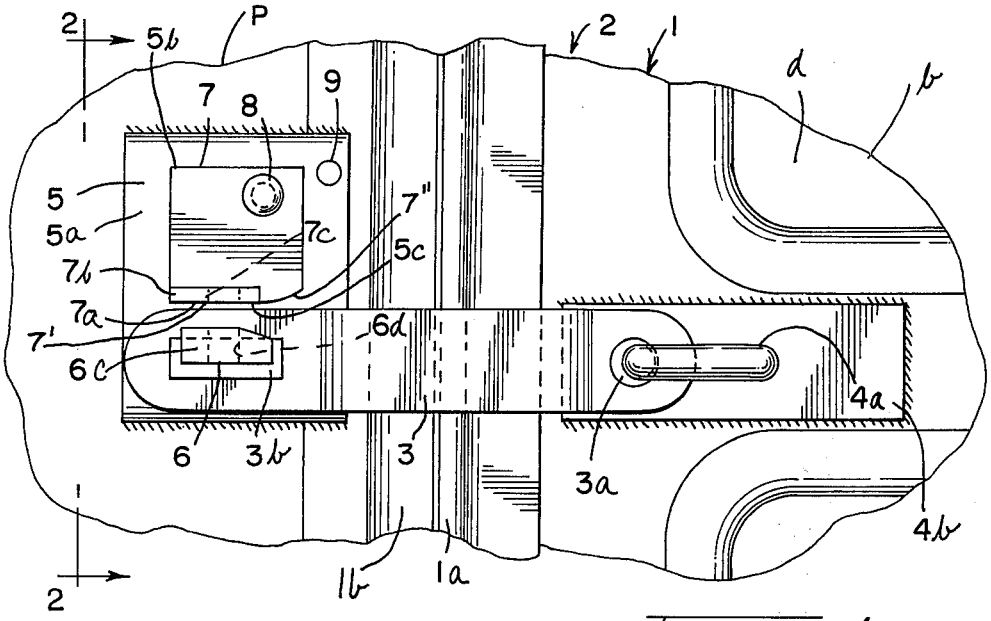
FIG. 1 is a side elevation view of the anti-pilferage locking device secured to the railway car.

With reference to the drawings and specifically to FIG. 1, there is shown a portion of the railroad boxcar *b*, having a sliding door *d* coupling with door post *p*. The post *p* and door *d* comprise the door structure 1. A novel and inventive anti-pilferage locking device 2 fixedly couples the door *d* with the post *p*.

Figure 3:
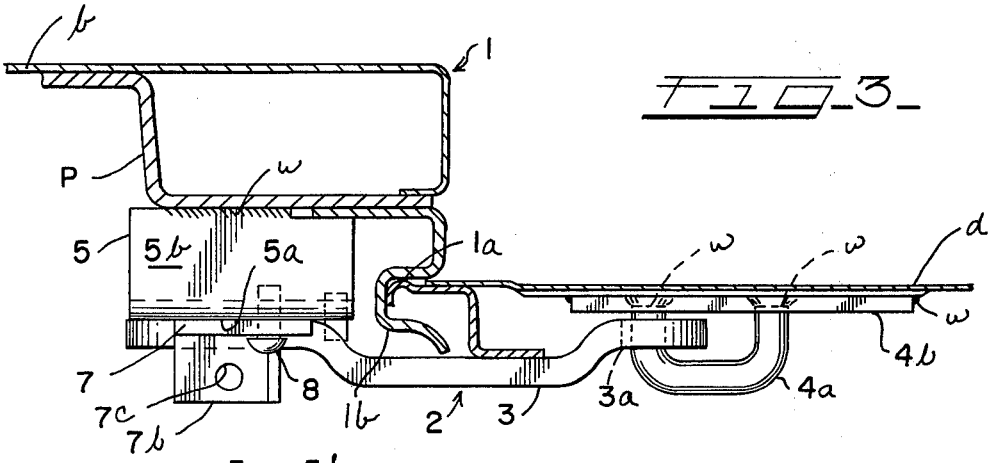
FIG. 3 is a plan view of the anti-pilferage locking device shown in FIG. 1.

As shown in FIGS. 1 and 3, the locking device 2 includes an elongated hasp 3 pivotally secured to the sliding door *d* adjacent to its confronting edge 1*a* by a U-shaped eye member 4*a*. More particularly, the eye member is laterally outstanding from the door *d* and is secured to the door through a reinforcing plate 4*b* welded to the door *d* as illustrated at *w*. To secure the hasp 3, the eye member entraps one end of the hasp 3 through a loose fitting attachment hole 3*a*. From this structure, it can be seen that the hasp 3 is freely pivotal on the member 4*a* in any direction.

Figure 2:
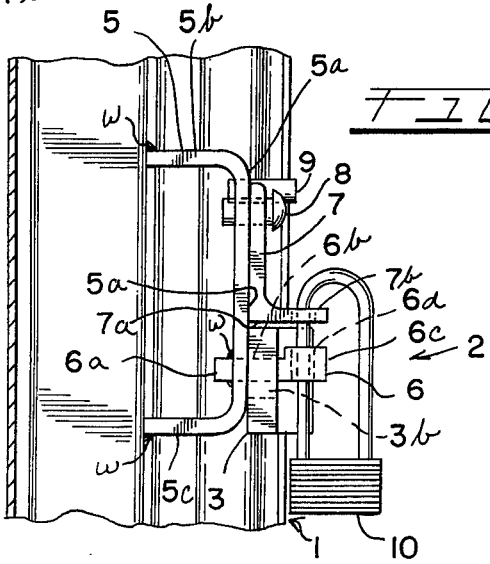
FIG. 2 is an end elevation view at line 2—2 of FIG. 1.

To fixedly couple the door *d* with the post *p*, the pivotally secured hasp 3 is receivably entrained on a laterally outstanding keeper 6 which is rigidly interconnected with the post *p* adjacent to its confronting edge 1b by a bracket 5. The bracket 5, shown in FIG. 2, is channel-shaped and includes a vertical outer plate 5*a* parallel to the post *p*. Additionally, the bracket 5 includes integral upper and lower flanges 5*b* and 5*c* extending inward from the upper and lower edges of the plate 5*a* to abut the post. Thus it can be seen that by welding the flanges 5*b* and 5*c* to the post *p* as shown at *w* in FIG. 2, the plate 5*a* provides a fixed mounting surface for rigidly interconnecting the keeper 6 with the post *p*. Therefore, to secure the keeper 6 to the bracket 5 and thereby interconnect it with the post *p*, its inner end 6*a* is welded to the plate 5*a* as indicated at *w* in FIG. 2.

The structure of the laterally outstanding keeper 6 includes an inner horizontal portion 6*b*, an outer vertical lip or catch 6*c*, and an aperture 6*d* vertically extending through the lip 6*c*. This structure, as discussed above, cooperates with the hasp 3 to fixedly couple the door *d* with the post *p*. Specifically, the free end of the hasp 3 is inwardly and downwardly entrained on the horizontal portion 6*b* through a slot or aperature 3*b* in the hasp 3 and thereby prevents longitudinal or downward movement of the hasp 3 when it is entrained on the keeper. Similarly, as particularly evident in FIG. 2, the catch 6c prevents laterally outward movement of the hasp 3.

The invention further discloses a locking cam 7 entrapping the hasp 3 entrained on the keeper 6 against upward vertical movement from the keeper. The cam 7 is vertically spaced above the keeper 6 and is pivotally secured to the plate 5*a* by a cam pivotal means 8 such as a nut and bolt combination, a rivet, or other pivotal means. The bottom edge 7*a* of the cam 7 has a flat edge portion 7′ at the end opposite the door structure 1, and has a curved or arcuate edge 7″ at the other end adjacent to the confronting edge 1*b*.

The pivotal mounting of the cam 7 provides for the curved edge portion 7″ of the bottom edge 7*a* to be horizontally offset from the pivotal means 8 and spaced above the hasp 3 to eliminate any tendency of the hasp to pivot the cam away, thereby allowing the hasp to escape. Additionally, as can be seen in FIG. 1, the upward or clockwise rotation of the cam 7 is limited by a cam abuting pin 9. Similarly, the downward or counter clockwise rotation of the cam is limited by interference between the hasp 3 and the flat edge portion 7′ of the bottom edge 7*a*.

The invention also discloses a means of sealingly securing the cam 7 in the position where it entraps the hasp 3. More particularly, the cam 7 additionally includes a laterally outstanding integral flange 7*b* which has an aperture 7*c* in substantial vertical alignment with the aperature 6*d* in the lip 6*c* of the keeper. The holes 7*c* and 6*d* provide for securing an anti-pilferage sealing means 10, such as a sealing cable or a padlock, through said vertically aligned apertures 7*c* and 6*d* to sealingly secure the cam in the hasp entrapping position.

From the above, it can be seen that all the longitudinal and lateral loads sustained by the anti-pilferage device are transferred directly through the hasp 3 to the keeper 6. Therefore, there are no shearing loads imposed on the sealing means 10. This feature clearly enhances the load bearing capability of the invention and facilitates its use as a secondary door locking device capable of sustaining the impact loads impressed on the door structure.

Additionally, and as a deterant to pilferage, the fact that no shearing loads are imposed on the sealing means 10 by the structure substantially improves the security of the anti-pilferage device. Specifically, since the sealing means 10 indirectly secures the hasp and keeper and therefore does not sustain any shearing loads, a thief attempting to gain access to the railway car cannot break the sealing means 10 by using the door structure against itself; i.e., by prying or wedging the car doors open to break the lock.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A door structure of a railway car including a first door engaging member having a first edge and a second door engaging member having a second edge confronting the first edge, an anti-pilferage locking device for securing the second door engaging member and the first door engaging member against longitudinal relative movement, the improvement comprising:

a keeper secured to the outer surface of the first member adjacent the first edge, said keeper including a substantially horizontal laterally outstanding portion and an elevated catch at its outer end having a vertical aperture therethrough, an elongated hasp pivotally secured on the outer surface of the door adjacent the second edge and having a loose fit therewith for multi-pivotal movement, said hasp having a free end portion having a slot therein, said slot in a locked position of said hasp receiving said keeper wherein said outstanding portion projects through said slot and said elevated catch overlaps a portion of said hasp to entrain the same against outward lateral movement, a cam vertically spaced above said keeper, means pivotally securing said cam to the outer surface of the first member adjacent the first edge, said cam including a bottom edge having a flat edge portion, a flange projecting outwardly from said cam, said cam having an aperture therethrough in substantially vertical alignment with the aperture in said catch, said means pivotally securing said cam to the outer surface of the first member being positioned vertically above said keeper and said flange and in substantial vertical alignment therewith whereby during a closed position of said hasp, said free end portion of said hasp is disposed immediately below said flat edge portion of said cam to restrain said hasp against upward movement, and anti-pilferage locking means within said apertures to secure said hasp on said keeper.

2. The invention according to claim 1, and a channel-shaped bracket having a platelike center portion and two parallel channel wall portions, said center portion being laterally outwardly spaced from and rigidly connected to the post adjacent the first edge by said channel wall portions, said keeper being carried by said bracket, and a cam stop positioned on said first member for limiting the pivoting movement of said cam and to maintain said cam in an out-of-the-way position relative to said hasp and keeper when said cam is pivoted to a raised position.

3. The invention in accordance with claim 1, said cam including a curved edge portion continuous to said flat edge portion, and said cam stop projecting outwardly from said first member and being horizontally spaced from said cam pivotal means.

* * * * *